US011107418B2

(12) United States Patent
Pyun et al.

(10) Patent No.: US 11,107,418 B2
(45) Date of Patent: Aug. 31, 2021

(54) LUMINANCE CONTROL DEVICE, DISPLAY DEVICE INCLUDING THE SAME, AND METHOD OF DRIVING THE SAME

(71) Applicant: SAMSUNG DISPLAY CO., LTD., Yongin-si (KR)

(72) Inventors: Kihyun Pyun, Gwangmyeong-si (KR); Sung-In Kang, Seoul (KR); Kyunho Kim, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/803,572

(22) Filed: Feb. 27, 2020

(65) Prior Publication Data

US 2020/0365091 A1 Nov. 19, 2020

(30) Foreign Application Priority Data

May 15, 2019 (KR) ..... 10-2019-0056892

(51) Int. Cl.
*G09G 3/3283* (2016.01)

(52) U.S. Cl.
CPC ... *G09G 3/3283* (2013.01); *G09G 2320/0233* (2013.01); *G09G 2330/02* (2013.01); *G09G 2360/16* (2013.01)

(58) Field of Classification Search
CPC ..... G09G 3/3283
USPC ..... 345/204, 589
See application file for complete search history.

(56) References Cited

U.S. PATENT DOCUMENTS

2009/0027410 A1* 1/2009 Inuzuka ..... H04N 19/48 345/555
2010/0045694 A1* 2/2010 Tanaka ..... G09G 3/342 345/589
2015/0320322 A1* 11/2015 Shylo ..... H01Q 19/062 343/762
2016/0182843 A1* 6/2016 Endo ..... H04N 5/2327 348/294
2018/0373248 A1 12/2018 Chornenky
2019/0007189 A1 1/2019 Hossain et al.

FOREIGN PATENT DOCUMENTS

KR 10-2016-0024067 3/2016
KR 10-2018-0078995 7/2018

* cited by examiner

*Primary Examiner* — Prabodh M Dharia
(74) *Attorney, Agent, or Firm* — F. Chau & Associates, LLC

(57) ABSTRACT

A display device includes a display panel including pixels, a luminance controller that divides the display panel into blocks based on coordinate information, calculates a block reference current based on a block current sensed in each of the blocks when reference images are sequentially displayed on the blocks, calculates a target current based on the block reference current and a block load of each of the blocks based on input image data, and calculates a scaling factor based on the target current and a sensing current sensed in each of the blocks when an input image corresponding to the input image data is displayed on the display panel, and a data driver that generates a data voltage corresponding to the input image data and supplies the data voltage to the pixels by adjusting a voltage level of the data voltage based on the scaling factor.

20 Claims, 8 Drawing Sheets

LUMINANCE CONTROL DEVICE, DISPLAY DEVICE INCLUDING THE SAME, AND METHOD OF DRIVING THE SAME

CROSS-REFERENCE TO RELATED APPLICATION

This application claims priority under 35 U.S.C. § 119 to Korean Patent Application No. 10-2019-0056892, filed on May 15, 2019 in the Korean Intellectual Property Office (KIPO), the disclosure of which is incorporated by reference herein in its entirety.

TECHNICAL FIELD

Exemplary embodiments of the inventive concept relate to a luminance control device, a display device including the luminance control device, and a method of driving the display device.

DISCUSSION OF RELATED ART

Recently, various flat panel display devices having reduced weight and volume, as compared to cathode ray tube (CRT) display devices, have been developed. Flat display devices include liquid crystal display (LCD) devices, field emission display (FED) devices, a plasma display panel (PDP) devices, and organic light emitting display (OLED) devices.

In general, a display panel of an organic light emitting display device includes a plurality of pixels. Each of the pixels includes an organic light emitting diode and a driving transistor that controls an amount of current flowing to the organic light emitting diode. The driving transistor may control luminance of light generated by the organic light emitting diode by controlling the amount of current flowing from a first power supply to a second power supply via the organic light emitting diode. However, as a driving time of the organic light emitting display device increases, the organic light emitting diode and the driving transistor deteriorate, and luminance of an image displayed on the display panel becomes uneven.

SUMMARY

According to an exemplary embodiment of the inventive concept, a display device may include a display panel including a plurality of pixels, a luminance controller configured to divide the display panel into a plurality of blocks based on coordinate information, to calculate a block reference current based on a block current sensed in each of the plurality of blocks when reference images are sequentially displayed on the plurality of blocks, to calculate a target current based on the block reference current and a block load of each of the plurality of blocks based on input image data, and to calculate a scaling factor based on the target current and a sensing current sensed in each of the plurality of blocks when an input image corresponding to the input image data is displayed on the display panel, and a data driver configured to generate a data voltage corresponding to the input image data and to supply the data voltage to the plurality of pixels by adjusting a voltage level of the data voltage based on the scaling factor.

In an exemplary embodiment of the inventive concept, the luminance controller may include a coordinate generator configured to generate the coordinate information for dividing the display panel into the plurality of blocks, a block image data generator configured to generate reference image data supplied to the data driver based on the coordinate information, a current sensor configured to sense the block current and the sensing current of each of the plurality of blocks, a block reference current calculator configured to calculate the block reference current based on the block current sensed by the current sensor, a memory configured to store the block reference current, a block load calculator configured to calculate the block load of each of the plurality of blocks based on the coordinate information and the input image data, a target current calculator configured to calculate the target current of each of the plurality of blocks based on the block reference current and the block load, and a scaling factor calculator configured to calculate the scaling factor based on the target current and the sensing current.

In an exemplary embodiment of the inventive concept, the block image data generator may sequentially supply the reference image data to the data driver, and the display panel may sequentially display the reference image corresponding to the reference image data on the plurality of blocks.

In an exemplary embodiment of the inventive concept, the block reference current calculator may output an average value of the block current sensed for a preset time period as the block reference current.

In an exemplary embodiment of the inventive concept, the block load calculator may calculate the block load of each of the plurality of blocks based on a total load of the input image data.

In an exemplary embodiment of the inventive concept, the current sensor may sense the block current when the display device is powered on or powered off.

In an exemplary embodiment of the inventive concept, the current sensor may sense the sensing current when the input image data is input.

In an exemplary embodiment of the inventive concept, the coordinate generator may generate the coordinate information including (m−1) x-axis coordinates and (n−1) y-axis coordinates, and the block image data generator may generate the reference image data supplied to (m×n) blocks based on the coordinate information, where m and n are natural numbers greater than 2.

In an exemplary embodiment of the inventive concept, the luminance controller may calculate the block reference current by sensing the block current when the display device is powered on or powered off and may store the block reference current in a memory.

In an exemplary embodiment of the inventive concept, each of the plurality of blocks may have a maximum load when the reference image is displayed on each of the plurality of blocks.

In an exemplary embodiment of the inventive concept, the reference image may include a white image.

According to an exemplary embodiment of the inventive concept, a luminance control device may include a coordinate generator configured to generate coordinate information for dividing a display panel of a display device into a plurality of blocks, a block image data generator configured to generate reference image data based on the coordinate information, a current sensor configured to sense a current flowing in each of the plurality of blocks, a block reference current calculator configured to calculate a block reference current based on a block current sensed in each of the plurality of blocks when reference images are sequentially displayed on the plurality of blocks, a memory configured to store the block reference current, a block load calculator configured to calculate a block load of each of the plurality of blocks based on the coordinate information and input image data, a target current calculator configured to calculate a target current of each of the plurality of blocks based on the block reference current and the block load, and a scaling factor calculator configured to calculate a scaling factor based on the target current and a sensing current sensed in each of the plurality of blocks when an input image corresponding to the input image data is displayed on the display panel.

In an exemplary embodiment of the inventive concept, the block image data generator may sequentially supply the reference image data to a data driver.

In an exemplary embodiment of the inventive concept, the block reference current calculator may output an average value of the block current sensed for a preset time period as the block reference current.

In an exemplary embodiment of the inventive concept, the block load calculator may calculate the block load of each of the plurality of blocks based on a total load of the input image data.

In an exemplary embodiment of the inventive concept, the current sensor may generate the block current by sensing a current in each of the plurality of blocks when the display device is powered on or powered off and may generate the sensing current by sensing the current in each of the plurality of blocks when the input image data is input.

In an exemplary embodiment of the inventive concept, the coordinate generator may generate the coordinate information including (m−1) x-axis coordinates and (n−1) y-axis coordinates, and the block image data generator may generate the reference image data supplied to (m×n) blocks based on the coordinate information, where m and n are natural numbers greater than 2.

In an exemplary embodiment of the inventive concept, each of the plurality of blocks may have a maximum load when the reference image is displayed on each of the plurality of blocks.

In an exemplary embodiment of the inventive concept, the reference image may include a white image.

According to an exemplary embodiment of the inventive concept, a method of driving a display device may include dividing a display panel into a plurality of blocks based on coordinate information, sequentially displaying reference images on each of the plurality of blocks, sensing a block current in each of the plurality of blocks, calculating a block reference current based on the block current, storing the block reference current, calculating a block load of each of the plurality of blocks based on the coordinate information and input image data, calculating a target current of each of the plurality of blocks based on the block reference current and the block load, displaying an input image corresponding to the input image data on the display panel, sensing a sensing current in each of the plurality of blocks, and calculating a scaling factor for controlling a voltage level of a data voltage corresponding to the input image data based on the sensing current and the target current.

BRIEF DESCRIPTION OF THE DRAWINGS

The above and other features of the inventive concept will be more fully understood by describing in detail exemplary embodiments thereof with reference to the accompanying drawings.

DETAILED DESCRIPTION OF THE EMBODIMENTS

Figure 1:
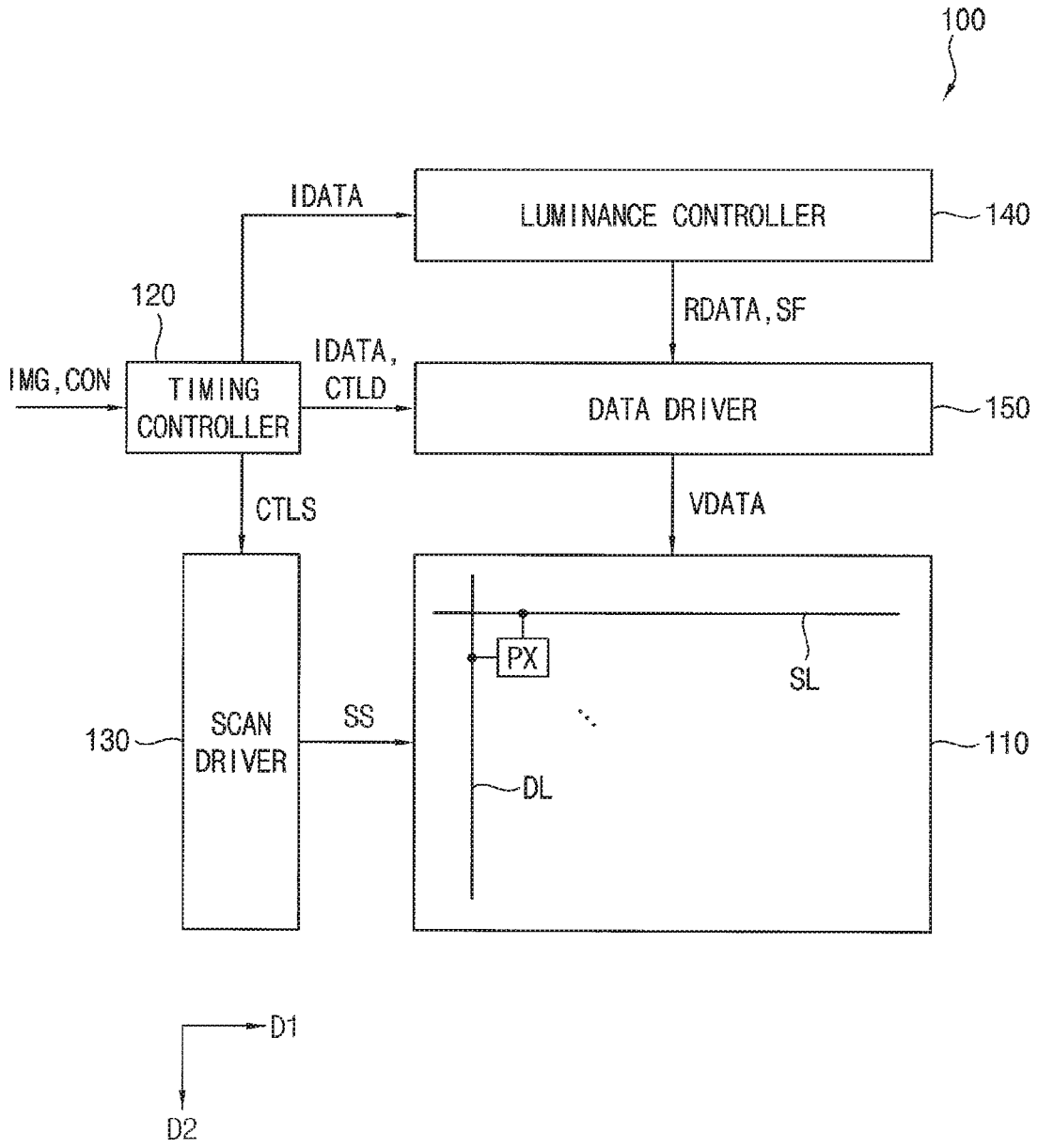
FIG. 1 is a block diagram illustrating a display device according to an exemplary embodiment of the inventive concept.

Exemplary embodiments of the inventive concept provide a luminance control device of a display device that can enhance display quality.

Exemplary embodiments of the inventive concept also provide a display device including a luminance control device that can enhance display quality.

Exemplary embodiments of the inventive concept further provide a method of driving a display device including a luminance control device that can enhance display quality.

Exemplary embodiments of the inventive concept will be described more fully hereinafter with reference to the accompanying drawings. Like reference numerals may refer to like elements throughout this application.

Figure 2:
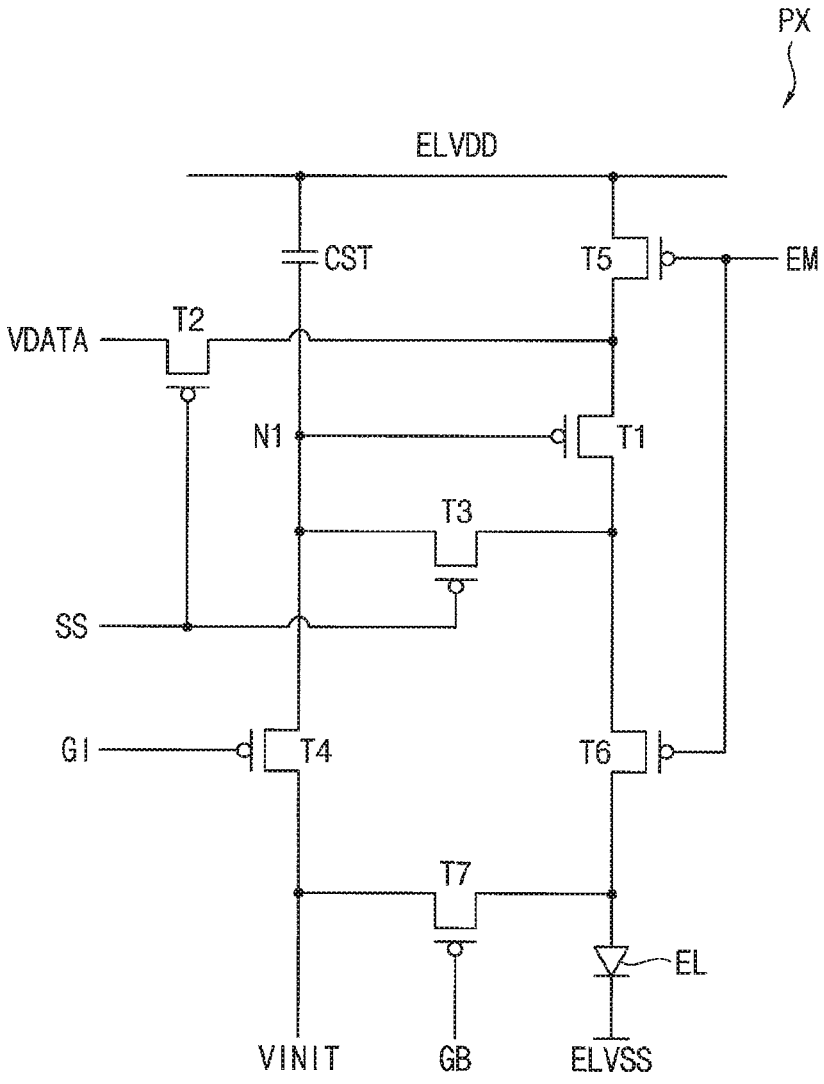
FIG. 2 is a circuit diagram illustrating a pixel included in the display device of FIG. 1 according to an exemplary embodiment of the inventive concept.

FIG. 1 is a block diagram illustrating a display device according to an exemplary embodiment of the inventive concept, and FIG. 2 is a circuit diagram illustrating a pixel included in the display device of FIG. 1 according to an exemplary embodiment of the inventive concept.

Referring to FIG. 1, a display device 100 may include a display panel 110, a data driver 150, and a luminance controller 140. The display device 100 may further include a timing controller 120 and a scan driver 130.

The display panel 110 may include data lines DL, scan lines SL, and a plurality of pixels PX. The scan lines SL may extend in a first direction D1 and may be arranged in a second direction D2 perpendicular to the first direction D1. The data lines DL may extend in the second direction D2 and may be arranged in the first direction D1. The first direction D1 may be substantially parallel to a long side of the display panel 110, and the second direction D2 may be substantially parallel to a short side of the display panel 110. The pixels PX may be formed in a region where the data lines DL intersect the scan lines SL.

Referring to FIG. 2, the pixel PX may include a first transistor T1, a second transistor T2, a third transistor T3, a fourth transistor T4, a fifth transistor T5, a sixth transistor T6, and a seventh transistor T7, a storage capacitor CST, and an organic light emitting diode EL.

The first transistor T1 may include a gate electrode connected to a first node N1, a first electrode connected to the second transistor T2, and a second electrode connected to the third transistor T3.

The second transistor T2 may include a gate electrode configured to receive a scan signal SS, a first electrode configured to receive a data voltage VDATA, and a second electrode connected to the first transistor T1.

The third transistor T3 may include a gate electrode configured to receive the scan signal SS, a first electrode connected to the first node N1, and a second electrode connected to the first transistor T1.

The fourth transistor T4 may include a gate electrode configured to receive a first initialization signal GI, a first electrode connected to the first node N1, and a second electrode configured to receive an initialization voltage VINIT.

The fifth transistor T5 may include a gate electrode configured to receive a light emitting control signal EM, a first electrode configured to receive a first power supply voltage ELVDD, and a second electrode connected to the first transistor T1.

The sixth transistor T6 may include a gate electrode configured to receive the light emitting control signal EM, a first electrode connected to the first transistor T1, and a second electrode connected to the organic light emitting diode EL.

The seventh transistor T7 may include a gate electrode configured to receive a second initialization signal GB, a first electrode configured to receive the initialization voltage VINIT, and a second electrode connected to the organic light emitting diode EL.

The organic light emitting diode EL may include a first electrode connected to the sixth transistor T6 and the seventh transistor T7, and a second electrode configured to receive a second power supply voltage ELVSS.

The storage capacitor CST may include a first electrode configured to receive the first power supply voltage ELVDD and a second electrode connected to the first node N1.

Although the pixel PX of FIG. 2 has a 7T-1C structure (e.g., including seven transistors and one capacitor), the pixel PX included in the display panel 110 is not limited thereto. For example, the pixel PX may have a 2T-1C structure (e.g., including two transistors and one capacitor) or have a hybrid structure including a first type transistor and a second type transistor.

The timing controller 120 may convert image data IMG supplied from an external device into input image data IDATA and may generate a data control signal CTLD and a scan control signal CTLS to control a driving of the input image data IDATA. The timing controller 120 may apply an algorithm configured to correct image quality (such as dynamic capacitance compensation (DCC)) to the image data IMG supplied from the external device, so that the image data IMG may be converted into the input image data IDATA. When the timing controller 120 does not include the algorithm for improving image quality, the image data IMG may be output as the input image data IDATA without changes. The timing controller 120 may supply the input image data IDATA to the luminance controller 140 and the data driver 150. The timing controller 120 may also receive an input control signal CON from the external device, and may generate the scan control signal CTLS provided to the scan driver 130 and the data control signal CTLD provided to the data driver 150. For example, the scan control signal CTLS may include a vertical start signal and at least one clock signal, and the data control signal CTLD may include a horizontal start signal and at least one clock signal.

The scan driver 130 may generate scan signals SS based on the scan control signal CTLS received from the timing controller 120. The scan driver 130 may output the scan signals SS to the pixels PX connected to the scan lines SL. In addition, the scan driver 130 may further generate a first initialization signal and a second initialization signal, and may output the first and second initialization signals to the pixels PX.

The luminance controller 140 may generate a scaling factor (or correction factor) SF configured to control a voltage level of the data voltage VDATA of the data driver 150 based on the input image data IDATA received from the timing controller 120.

The luminance controller 140 may divide the display panel 110 into a plurality of blocks based on coordinate information. For example, the luminance controller 140 may divide the display panel 110 into one hundred blocks based on the coordinate information. The luminance controller 140 may sequentially display preset reference images on a plurality of blocks when the display device 100 is powered on or powered off, and may sense a block current from each of the blocks. The reference image may be an image corresponding to reference image data RDATA output from the luminance controller 140.

When the reference image is displayed on each of the blocks, each of the blocks may have a largest load. For example, the reference image may be a white image. In other words, when each of the blocks has the largest load (maximum load), the luminance controller 140 may sense a current flowing in each of the blocks. Although each of the blocks has the same load (e.g., the maximum load), the block current sensed by a current sensor may vary according to the characteristics and the degree of deterioration of pixels included in each of the blocks.

The luminance controller 140 may calculate a block reference current of each of the blocks by calculating a block current sensed for a preset time period. For example, the luminance controller 140 may sense a block current of a first block for 60 seconds and may calculate and store an average value of the sensed block currents as a block reference current of the first block.

The luminance controller 140 may receive the input image data IDATA upon driving of the display device 100, may calculate a total load of the input image data IDATA, and may calculate a block load of each block based on the total load of the input image data IDATA.

The luminance controller 140 may calculate a target current based on the block reference current and the block load. For example, the luminance controller 140 may calculate the target current by multiplying the ratio of the block load to the maximum load by the block reference current.

When an input image corresponding to the input image data IDATA is displayed on each of the blocks of the display panel 110, the luminance controller 140 may sense a sensing current of each of the blocks. The luminance controller 140 may calculate the scaling factor SF configured to control the voltage level of the data voltage VDATA based on the target current and the sensing current. Hereinafter, the luminance controller 140 will be described in detail with reference to FIG. 3.

The data driver 150 may generate the data voltage VDATA (e.g., an analog type voltage) based on the input image data IDATA received from the timing controller 120 and the scaling factor SF received from the luminance controller 140. The data driver 150 may generate the data voltage VDATA corresponding to the input image data IDATA and may adjust a voltage level of the data voltage VDATA based on the scaling factor SF supplied from the luminance controller 140. The data driver 150 may output data voltages VDATA to the pixels PX connected to the data lines DL based on the data control signal CTLD.

As described above, in the display device 100, the display panel 110 may be divided into a plurality of blocks, a target current may be calculated based on the block current and the block load of each of the blocks, and the scaling factor SF that controls the voltage level of the data voltage VDATA may be calculated based on the sensing current and the target current of each of the blocks. As such, a luminance difference between the blocks can be reduced. Therefore, the luminance uniformity of the display device 100 can be improved.

Figure 3:
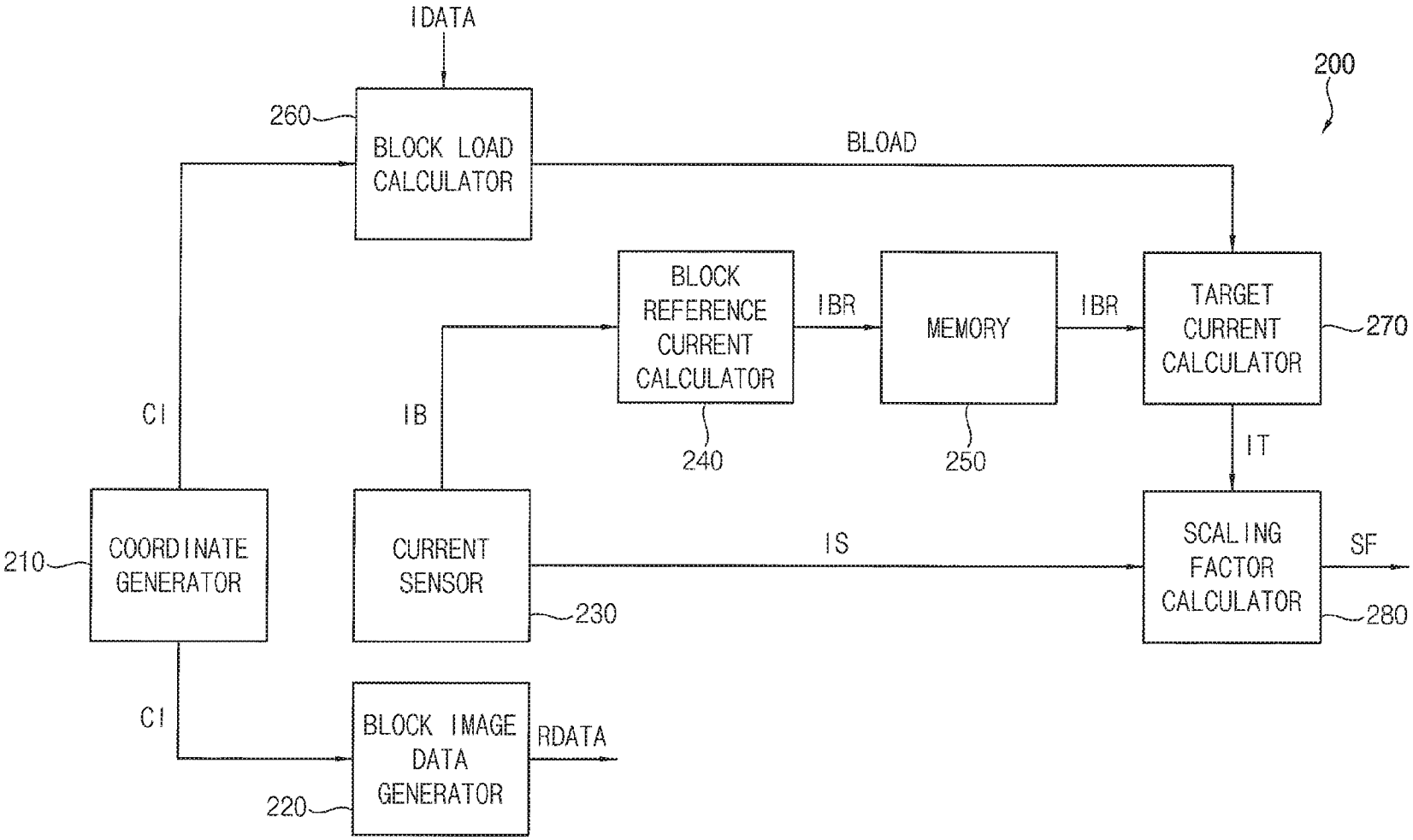
FIG. 3 is a circuit diagram illustrating a luminance controller included in the display device of FIG. 1 according to an exemplary embodiment of the inventive concept.
Figure 4:
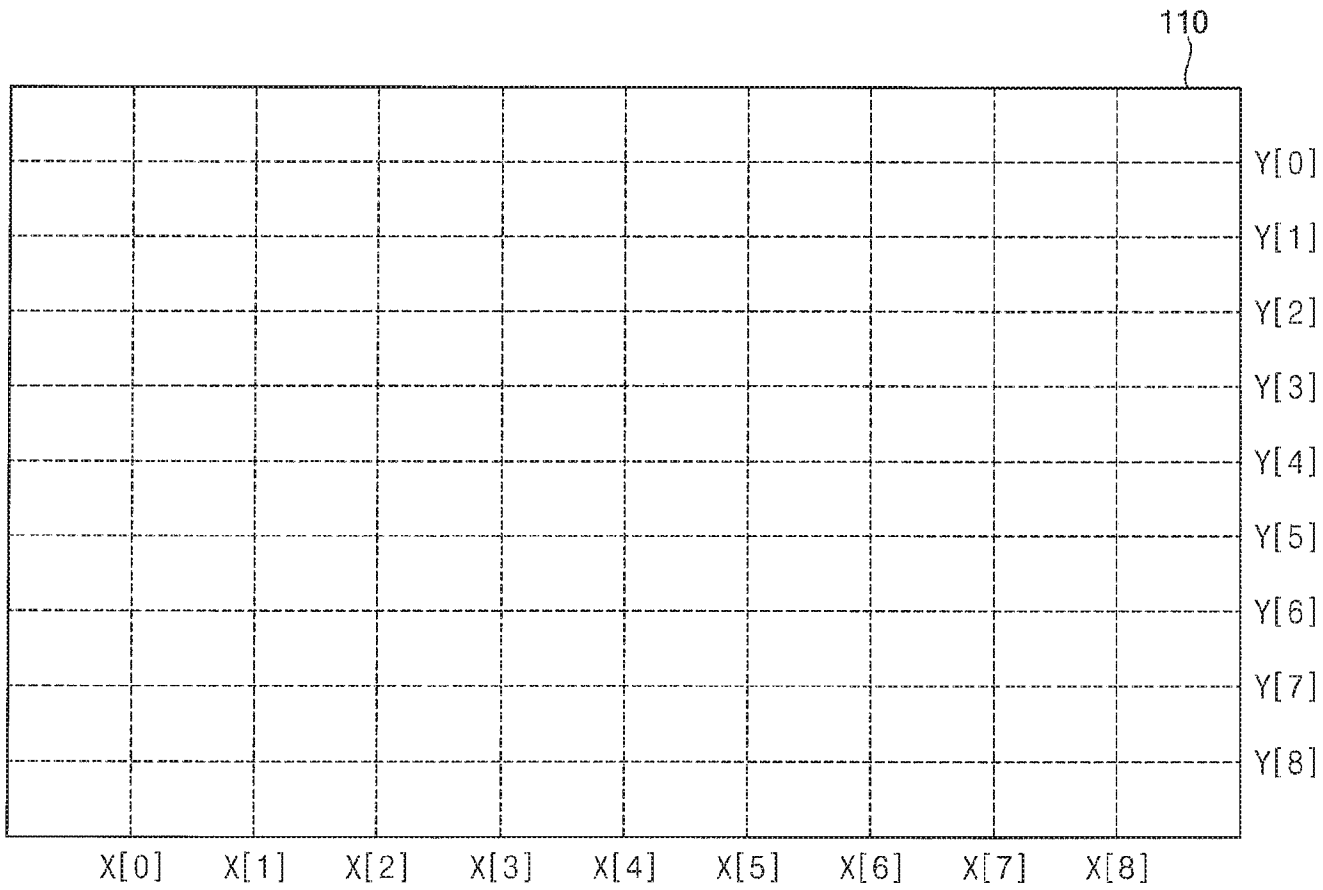
FIG. 4 is a diagram for describing an operation of a coordinate generator included in the luminance controller of FIG. 3 according to an exemplary embodiment of the inventive concept.

FIG. 3 is a circuit diagram illustrating a luminance controller included in the display device of FIG. 1 according to an exemplary embodiment of the inventive concept, and FIG. 4 is a diagram for describing an operation of a coordinate generator included in the luminance controller of FIG. 3 according to an exemplary embodiment of the inventive concept.

Referring to FIG. 3, a luminance controller 200 may include a coordinate generator 210, a block image data generator 220, a current sensor 230, a block reference current calculator 240, a memory 250, a block load calculator 260, a target current calculator 270, and a scaling factor calculator 280. The luminance controller 200 of FIG. 3 may correspond to the luminance controller 140 of FIG. 1.

The coordinate generator 210 may generate coordinate information CI to divide the display panel 110 into a plurality of blocks. The coordinate generator 210 may generate the coordinate information CI including (m−1) x-axis coordinates and (n−1) y-axis coordinates and may divide the display panel 110 into (m×n) blocks, where m and n are natural numbers greater than 2. For example, as shown in FIG. 4, the coordinate generator 210 may generate coordinate information CI including nine x-axis coordinates and nine y-axis coordinates and may divide the display panel 110 into 10×10 blocks, e.g., 100 blocks. The blocks may have the same sizes in the x-axis direction and the y-axis direction, respectively. For example, when the display panel 110 having a resolution of 3840×2160 is divided into 10×10 blocks, each block may include 384 pixels in the x-axis direction and may include 216 pixels in the y-axis direction.

The block image data generator 220 may generate the reference image data RDATA supplied to the data driver (e.g., 150 of FIG. 1) based on the coordinate information CI. The block image data generator 220 may generate the reference image data RDATA when the display device is powered on or powered off. The block image data generator 220 may sequentially supply the reference image data RDATA supplied to each of the blocks to the data driver. When the reference image corresponding to the reference image data RDATA is displayed on the display panel 110, each of the blocks may have the largest load (maximum load). For example, the reference image may be a white image.

The current sensor 230 may sense a block current IB and a sensing current IS of each of the blocks. The current sensor 230 may sense the block current IB when the display device is powered on or powered off. When the reference image data RDATA generated by the block image data generator 220 is sequentially supplied to the data driver, the reference image may be sequentially displayed on each of the blocks of the display panel 110. The current sensor 230 may sense the block current IB of the block on which the reference image is displayed. When the reference image is displayed on each of the blocks of the display panel 110, each of the blocks may have the maximum load. In other words, when each of the blocks has the largest load (maximum load), the current sensor 230 may sense the block current IB flowing in each of the blocks.

Although each of the blocks has the same load (e.g., the maximum load), the block current IB sensed by the current sensor 230 may vary according to the characteristics and the degree of deterioration of pixels included in each of the blocks. The current sensor 230 may measure the block current IB for a preset time period. For example, when the display device is driven at 120 Hz and when the current sensor 230 measures the block current IB of the block, which displays the reference image, for one second, the current sensor 230 may measure the block current IB 120 times. Meanwhile, the current sensor 230 may sense a sensing current IS when the display device is driven. When the display device is driven, the input image corresponding to the input image data IDATA may be displayed on each of the blocks. When the input image corresponding to the input image data IDATA is displayed on each of the blocks, the current sensor 230 may measure the sensing current IS flowing in each of the blocks.

The block reference current calculator 240 may calculate a block reference current IBR based on the block current IB sensed by the current sensor 230. The block reference current calculator 240 may calculate an average value of the block currents IB measured for a preset time period in one block as the block reference current IBR. For example, when the current sensor 230 measures the block current IB 120 times during the preset time period, the block reference current calculator 240 may calculate an average value of 120 block currents IB as the block reference current IBR.

The memory 250 may store the block reference current IBR supplied from the block reference current calculator 240.

The block load calculator 260 may calculate a block load BLOAD of each of the blocks based on the coordinate information CI and the input image data IDATA. The block load calculator 260 may receive the coordinate information CI from the coordinate generator 210 and may receive the input image data IDATA from the timing controller (e.g., 120 of FIG. 1). The block load calculator 260 may calculate a total load of the input image data IDATA and may calculate the block load BLOAD of each of the blocks based on the total load of the input image data IDATA.

The target current calculator 270 may calculate a target current IT of each of the blocks based on the block reference current IBR and the block load BLOAD. The target current calculator 270 may receive the block reference current IBR stored in the memory 250 and may receive the block load BLOAD from the block load calculator 260. Because the block reference current IBR is the current flowing in each of the blocks when each of the blocks has the maximum load, the target current calculator 270 may calculate the target current IT based on the ratio of the block load BLOAD to the maximum load, and the block reference current IBR. For example, when one of the blocks has the maximum load of 10, the block reference current IBR of 5 mA, and the block load BLOAD of 2, the target current calculator 270 may obtain the target current IT of 1 mA by multiplying 5 mA of the block reference current IBR by 0.2, which is the ratio of the block load BLOAD to the maximum load.

The scaling factor calculator 280 may calculate the scaling factor SF based on the target current IT and the sensing current IS. The scaling factor calculator 280 may receive the target current IT of each of the blocks from the target current calculator 270, and may receive the sensing current IS, which flows in each of the blocks when the input image corresponding to the input image data IDATA is displayed on the display panel 110, from the current sensor 230. The scaling factor calculator 280 may calculate the scaling factor SF by comparing the target current IT with the sensing current IS. The scaling factor calculator 280 may output the scaling factor SF to the data driver.

According to an exemplary embodiment of the inventive concept, each element of the luminance controller 200 may be implemented as a circuit.

Figure 5A:
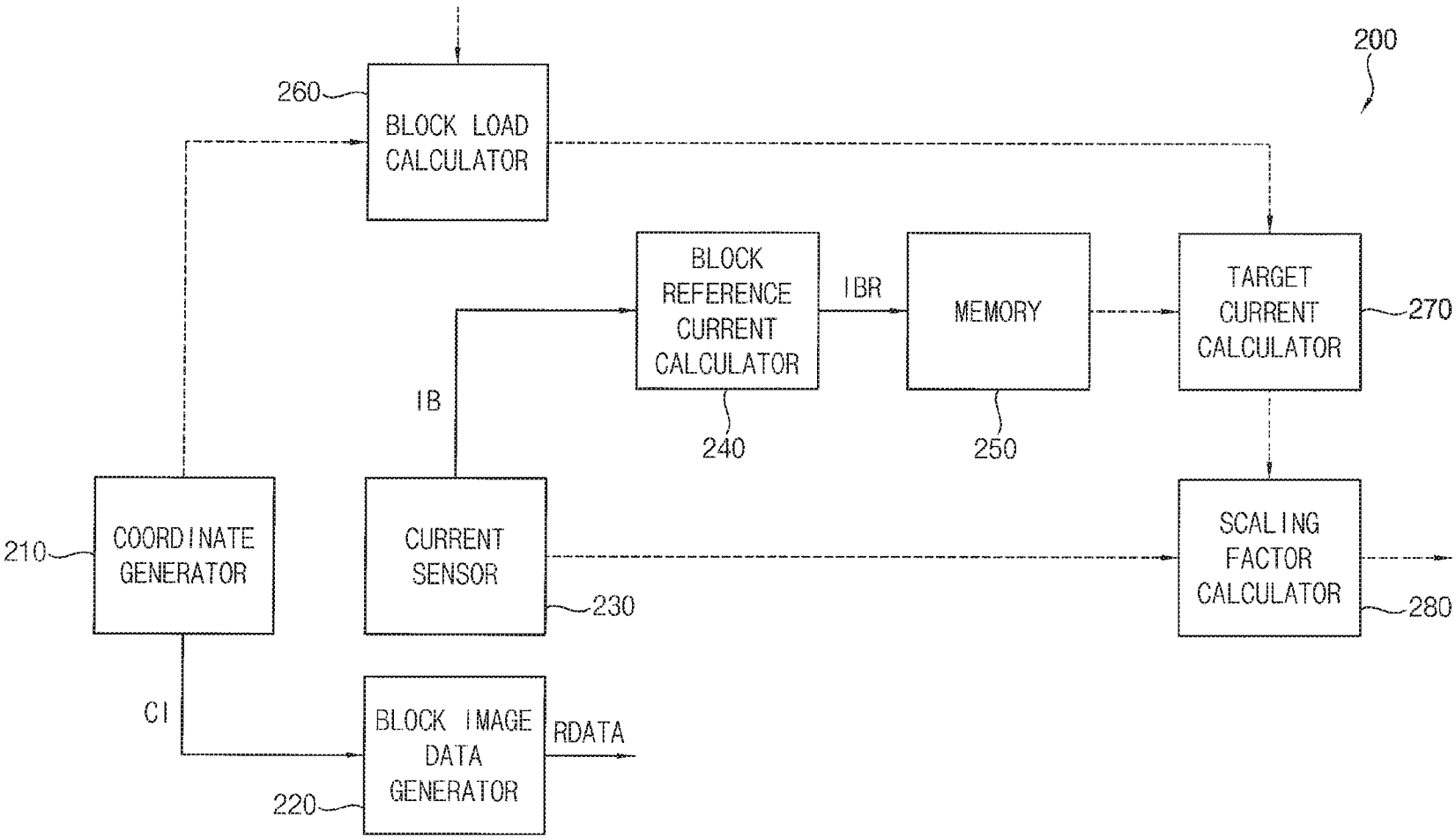
FIGS. 5A and 5B are diagrams for describing an operation of the luminance controller of FIG. 3 according to an exemplary embodiment of the inventive concept.
Figure 5B:
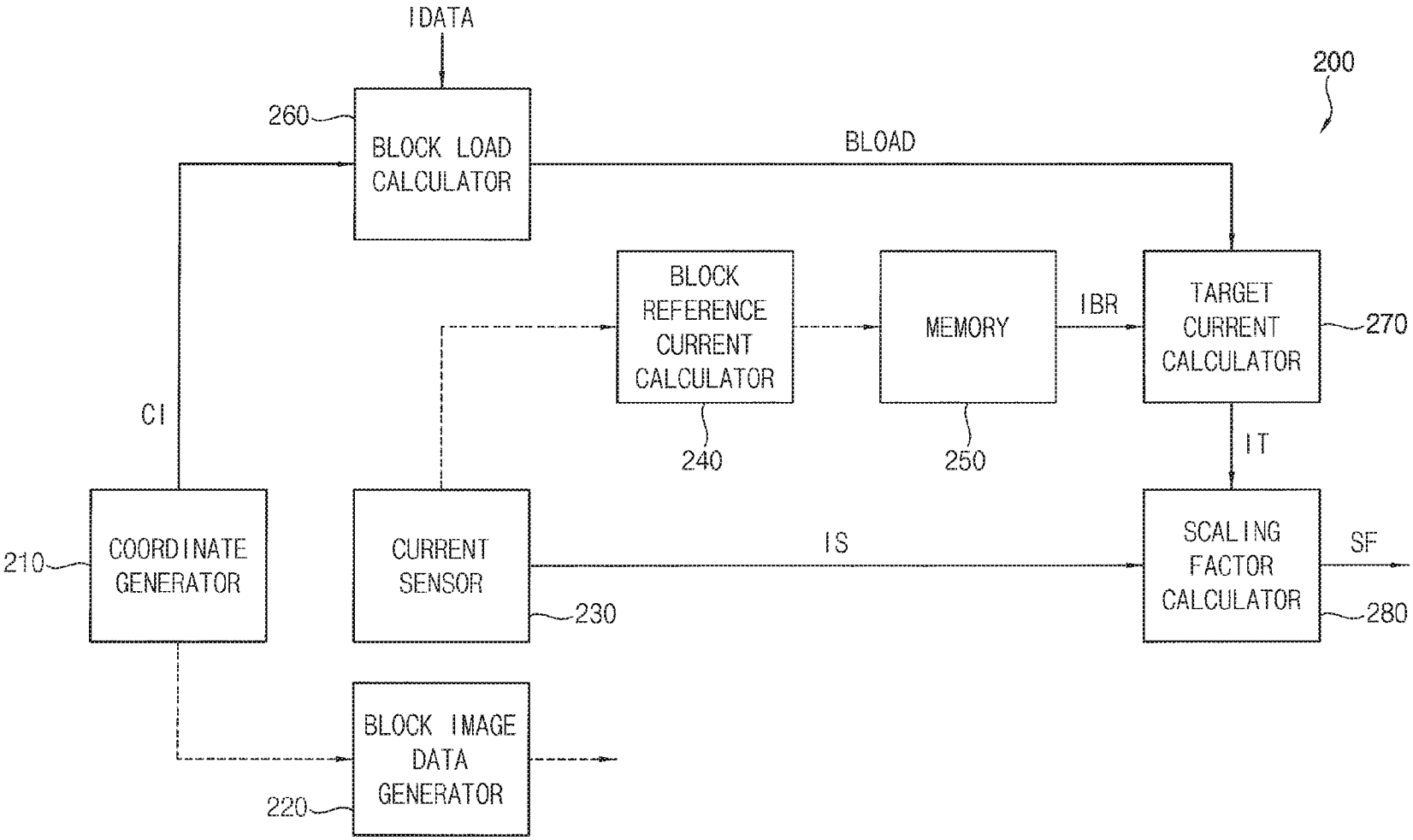
Figure 6:
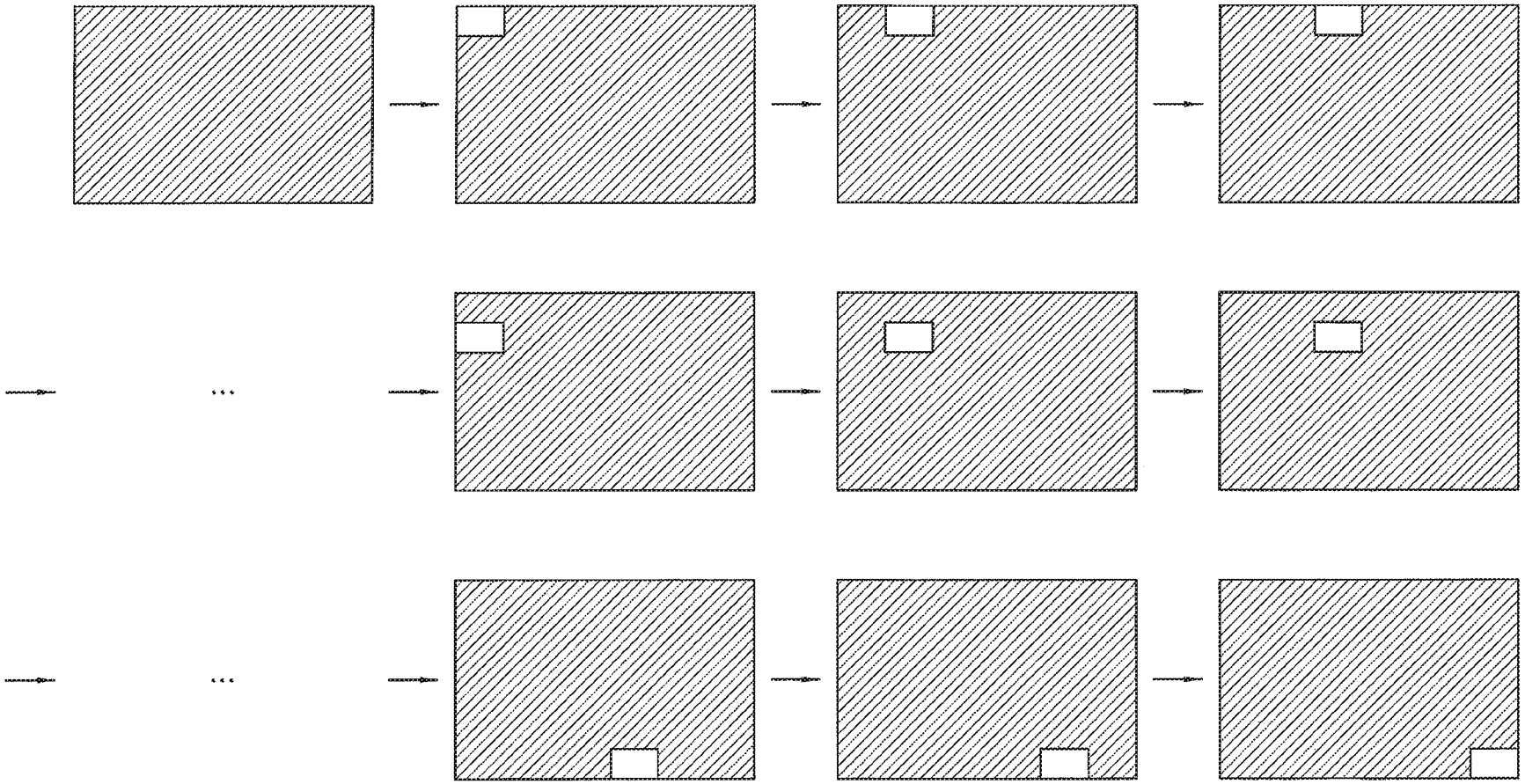
FIG. 6 is a diagram for describing an operation of a block image data generator included in the luminance controller of FIG. 5A according to an exemplary embodiment of the inventive concept.

FIGS. 5A and 5B are diagrams for describing an operation of the luminance controller of FIG. 3 according to an exemplary embodiment of the inventive concept, and FIG. 6 is a diagram for describing an operation of a block image data generator included in the luminance controller of FIG. 5A according to an exemplary embodiment of the inventive concept.

FIG. 5A is a diagram for describing the operation of the luminance controller 200 when the display device is powered on or powered off. Referring to FIG. 5A, when the display device is powered on or powered off, the coordinate generator 210 of the luminance controller 200 may generate the coordinate information CI to divide the display panel 110 into a plurality of blocks. The coordinate generator 210 may generate the coordinate information CI including (m−1) x-axis coordinates and (n−1) y-axis coordinates and may divide the display panel 110 into (m×n) blocks, where m and n are natural numbers greater than 2. The coordinate generator 210 may supply the coordinate information CI to the block image data generator 220.

The block image data generator 220 may generate the reference image data RDATA supplied to the data driver based on the coordinate information CI. When the reference image corresponding to the reference image data RDATA is displayed on each of the blocks, each of the blocks may have the largest load (e.g., the maximum load). For example, the reference image may be a white image. The reference image data RDATA generated by the block image data generator 220 may be supplied to the data driver. The data driver may generate data voltages corresponding to the reference image data RDATA and may sequentially supply the data voltages to each of the blocks of the display panel 110.

Referring to FIG. 6, the reference image may be sequentially displayed on each of the blocks of the display panel 110 for a preset time period based on the reference image data RDATA supplied from the data driver. For example, the display panel 110 may be divided into 100 blocks based on the coordinate information CI, and the reference image may be displayed on each of the blocks for one second. For example, the reference image may be a white image, and a background image displaying the reference image may be a black image.

The current sensor 230 may sense the block current IB of each of the blocks. The current sensor 230 may sense the block current IB flowing in each of the blocks while the reference image is displayed on each of the blocks of the display panel 110. The current sensor 230 may measure the block current IB of each of the blocks for the preset time period. For example, when the display device is driven at 120 Hz and when the current sensor 230 measures the block current IB of the block, which displays the reference image, for one second, the current sensor 230 may measure the block current IB 120 times. The current sensor 230 may supply the block current IB to the block reference current calculator 240.

The block reference current calculator 240 may calculate the block reference current IBR based on the block current IB supplied from the current sensor 230. The block reference current calculator 240 may calculate an average value of the block currents IB measured in each of the blocks for a preset time period as the block reference current IBR. For example, when the current sensor 230 measures the block current IB of one block 120 times during the preset time period, the block reference current calculator 240 may calculate an average value of 120 block currents IB as the block reference current IBR of the block. The block reference current calculator 240 may supply the block reference current IBR of each of the blocks to the memory 250.

The memory 250 may store the block reference current IBR of each of the blocks supplied from the block reference current calculator 240.

FIG. 5B is a diagram for describing the operation of the luminance controller 200 when the display device is driven. Referring to FIG. 5B, the coordinate generator 210 of the luminance controller 200 may generate the coordinate information CI to divide the display panel 110 into a plurality of blocks. The coordinate information CI may be the same as the coordinate information CI supplied to the block image data generator 220 when the display device is powered on or powered off. For example, the coordinate generator 210 may generate the coordinate information CI including (m−1) x-axis coordinates and (n−1) y-axis coordinates and may divide the display panel 110 into (m×n) blocks, where m and n are natural numbers greater than 2. The coordinate generator 210 may supply the coordinate information CI to the block load calculator 260.

The block load calculator 260 may calculate the block load BLOAD of each of the blocks based on the coordinate information CI and the input image data IDATA. The block load calculator 260 may receive the coordinate information CI from the coordinate generator 210 and may receive the input image data IDATA from the timing controller. The block load calculator 260 may calculate a total load of the input image data IDATA and may calculate the block load BLOAD of each of the blocks based on the total load of the input image data IDATA. The block load calculator 260 may supply the block load BLOAD to the target current calculator 270.

The memory 250 may supply the stored block reference current IBR to the target current calculator 270.

The target current calculator 270 may receive the block reference current IBR and the block load BLOAD, and may calculate the target current IT of each of the blocks based on the block reference current IBR and the block load BLOAD. The target current calculator 270 may receive the block reference current IBR stored in the memory 250 and may receive the block load BLOAD from the block load calculator 260. The target current calculator 270 may calculate the target current IT based on the block reference current IBR and the ratio of the block load BLOAD to the maximum load. In other words, the ratio of the block load BLOAD of each block to the maximum load is obtained. Then, the ratio of the block load BLOAD to the maximum load is multiplied by the block reference current IBR that is the current flowing in each of the blocks when each of the block has the maximum load, to calculate the target current IT. The target current calculator 270 may supply the target current IT to the scaling factor calculator 280.

The current sensor 230 may sense the sensing current IS of each of the blocks. The current sensor 230 may sense the sensing current IS flowing in each of the blocks while the input image corresponding to the input image data IDATA is displayed on the display panel 110.

The scaling factor calculator 280 may receive the target current IT of each of the blocks from the target current calculator 270 and may receive the sensing current IS of each of the blocks from the current sensor 230. The scaling factor calculator 280 may calculate the scaling factor SF by comparing the target current IT with the sensing current IS. For example, the scaling factor SF may have a value greater than or equal to 1 when the sensing current IS is less than or equal to the target current IT, and the scaling factor SF may have a value less than 1 when the sensing current IS is greater than the target current IT. The scaling factor calculator 280 may supply the scaling factor SF to the data driver.

The data driver may generate an analog type data voltage based on the input image data IDATA supplied from the timing controller and may control a voltage level of the data voltage based on the scaling factor SF supplied from the luminance controller 200. For example, the data driver may increase the voltage level of the data voltage when the scaling factor SF having a value greater than or equal to 1 is supplied and may decrease the voltage level of the data voltage when the scaling factor SF having a value less than 1 is supplied.

As described above, the luminance controller 200 may divide the display panel 110 into a plurality of blocks, may calculate the target current IT of each of the blocks based on the block reference current IBR when the load of each of the blocks is maximum and the block load BLOAD that is a load for each block of the input image data IDATA, and may calculate the scaling factor SF by comparing the sensing current IS flowing in each of the blocks with the target current IT when the input image corresponding to the input image data IDATA is displayed on the display panel 110. As such, the luminance difference between the blocks can be reduced. Therefore, the luminance uniformity of the display device can be improved.

Figure 7:
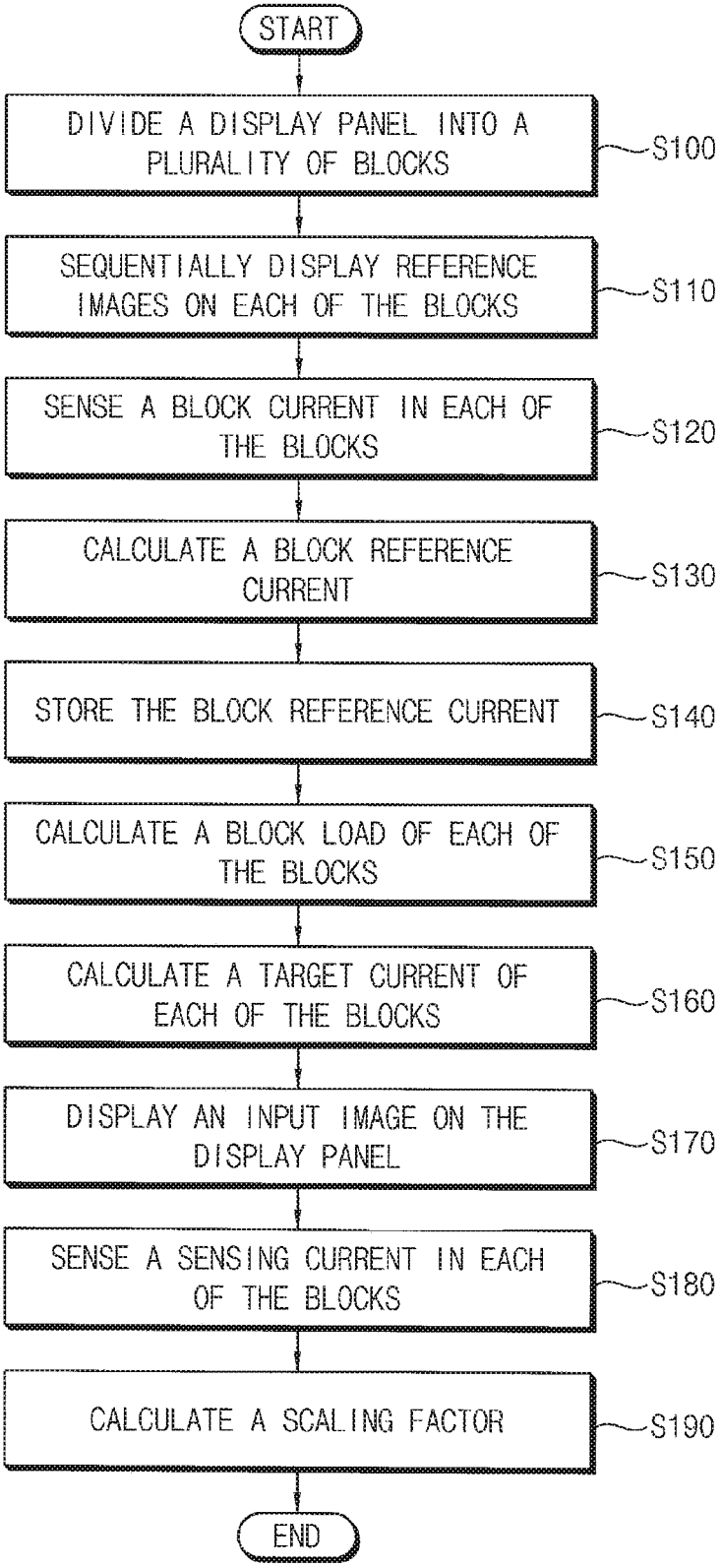
FIG. 7 is a flowchart illustrating a method of driving a display device according to an exemplary embodiment of the inventive concept.

FIG. 7 is a flowchart illustrating a method of driving a display device according to an exemplary embodiment of the inventive concept.

Referring to FIG. 7, the method of FIG. 7 may include dividing the display panel into a plurality of blocks (S100), sequentially displaying the reference image on each of the blocks (S110), sensing the block current of each of the blocks (S120), calculating the block reference current of each of the blocks (S130), storing the block reference current (S140), calculating the block load of each of the blocks (S150), calculating the target current of each of the blocks (S160), displaying the input image on the display panel (S170), sensing the sensing current of each of the blocks (S180), and calculating the scaling factor (S190).

According to the method of FIG. 7, the display panel may be divided into a plurality of blocks based on coordinate information (S100). For example, the coordinate information may include information on x-axis coordinates and y-axis coordinates.

According to the method of FIG. 7, the coordinate information including (m−1) x-axis coordinates and (n−1) y-axis coordinates may be generated, and the display panel may be divided into m×n blocks, where m and n are natural numbers greater than 2.

According to the method of FIG. 7, a preset reference image may be sequentially displayed on each of the blocks (S110). According to the method of FIG. 7, reference image data may be generated at power-on or power-off of the display device, and the reference image corresponding to the reference image data may be sequentially displayed on each of the blocks of the display panel for a preset time period. When the reference image is displayed on each of the blocks of the display panel, each of the blocks may have the maximum load. For example, the reference image may be a white image.

According to the method of FIG. 7, each block current may be sensed (S120). According to the method of FIG. 7, the block current flowing in each of the blocks may be sensed while the reference image is displayed on each of the blocks of the display panel. According to the method of FIG. 7, the block current of each of the blocks may be measured during the preset time period when the reference image is displayed on each of the blocks.

According to the method of FIG. 7, the block reference current may be calculated based on the block current (S130). According to the method of FIG. 7, the average value of the block currents measured for a preset time period in one block may be calculated as the block reference current of the block.

According to the method of FIG. 7, the block reference current may be stored in the storage device (S140).

According to the method of FIG. 7, the block load of each of the blocks may be calculated based on the coordinate information and the input image data (S150). According to the method of FIG. 7, the display panel may be divided into the blocks based on the coordinate information, and the block load of each of the blocks may be calculated based on the input image data. According to the method of FIG. 7, the block load of each of the blocks may be calculated based on the total load of the input image data.

According to the method of FIG. 7, the target current of each of the blocks may be calculated based on the block reference current and the block load (S160). According to the method of FIG. 7, the target current may be calculated based on the ratio of the block load to the maximum load, and the block reference current. In other words, the target current corresponding to the block load may be calculated based on the block reference current flowing in each of the blocks when each of the blocks has the maximum load.

According to the method of FIG. 7, the input image corresponding to the input image data may be displayed on the display panel (S170). When the display device is driven, the input image may be displayed on the display panel.

According to the method of FIG. 7, the sensing current of each of the blocks may be sensed (S180). According to the method of FIG. 7, the sensing current flowing in each of the blocks may be sensed while the input image is displayed on the display panel.

According to the method of FIG. 7, the scaling factor configured to control the data voltage corresponding to the input image data may be calculated based on the sensing current and the target current (S190). According to the method of FIG. 7, the scaling factor may be calculated by comparing the target current with the sensing current of each of the blocks. For example, according to the method of FIG. 7, the ratio of the target current to the sensing current may be calculated as the scaling factor.

The method of FIG. 7 may further include generating the data voltage based on the input image data and the scaling factor. According to the method of FIG. 7, an analog type data voltage may be generated based on the input image data, and the voltage level of the data voltage may be controlled based on the scaling factor.

As described above, according to the method of FIG. 7, the display panel may be divided into a plurality of blocks, the target current of each of the blocks may be calculated based on the block current when the load of each of the blocks is maximum and the block load that is a load for each block of the input image data, and the scaling factor may be calculated by comparing the sensing current flowing in each of the blocks with the target current when the input image corresponding to the input image data is displayed on the display panel. As such, the luminance difference between the blocks can be reduced. Therefore, the luminance uniformity of the display device can be improved.

The inventive concept may be applied to an electronic device including a display device. For example, the inventive concept may be applied to a television, a computer monitor, a laptop, a digital camera, a cellular phone, a smart phone, a smart pad, a tablet personal computer (PC), a portable multimedia player (PMP), a personal digital assistant (PDA), an MP3 player, a navigation system, a video phone, a head mounted display (HMD) device, etc.

Therefore, a luminance control device, a display device, and a method of driving a display device according to exemplary embodiments of the inventive concept may reduce a luminance difference between a plurality of blocks by dividing a display panel into the blocks, by calculating a target current based on a block current and a block load of each of the blocks, and by calculating a scaling factor that controls a voltage level of a data voltage based on the target current and a sensing current of each of the blocks. Accordingly, uniformity of the display panel may be improved, and display quality may be enhanced.

While the inventive concept has been shown and described with reference to exemplary embodiments thereof, it will be apparent to those of ordinary skill in the art that various modifications in form and details may be made thereto without departing from the spirit and scope of the inventive concept as set forth by the appended claims.

What is claimed is:

1. A display device comprising:

a display panel including a plurality of pixels;

a luminance controller configured to divide the display panel into a plurality of blocks based on coordinate information, to calculate a block reference current based on a block current sensed in each of the plurality of blocks when a reference image is sequentially displayed on the plurality of blocks, to calculate a target current based on the block reference current and a block load of each of the plurality of blocks based on input image data, and to calculate a scaling factor based on the target current and a sensing current sensed in each of the plurality of blocks when an input image corresponding to the input image data is displayed on the display panel; and a data driver configured to generate a data voltage corresponding to the input image data and to supply the data voltage to the plurality of pixels by adjusting a voltage level of the data voltage based on the scaling factor.

2. The display device of claim 1, wherein the luminance controller includes:

a coordinate generator configured to generate the coordinate information for dividing the display panel into the plurality of blocks;

a block image data generator configured to generate reference image data supplied to the data driver based on the coordinate information;

a current sensor configured to sense the block current and the sensing current of each of the plurality of blocks;

a block reference current calculator configured to calculate the block reference current based on the block current sensed by the current sensor;

a memory configured to store the block reference current;

a block load calculator configured to calculate the block load of each of the plurality of blocks based on the coordinate information and the input image data;

a target current calculator configured to calculate the target current of each of the plurality of blocks based on the block reference current and the block load; and a scaling factor calculator configured to calculate the scaling factor based on the target current and the sensing current.

3. The display device of claim 2, wherein the block image data generator sequentially supplies the reference image data to the data driver, and the display panel sequentially displays the reference image corresponding to the reference image data on the plurality of blocks.

4. The display device of claim 2, wherein the block reference current calculator outputs an average value of the block current sensed for a preset time period as the block reference current.

5. The display device of claim 2, wherein the block load calculator calculates the block load of each of the plurality of blocks based on a total load of the input image data.

6. The display device of claim 2, wherein the current sensor senses the block current when the display device is powered on or powered off.

7. The display device of claim 2, wherein the current sensor senses the sensing current when the input image data is input.

8. The display device of claim 2, wherein the coordinate generator generates the coordinate information including (m−1) x-axis coordinates and (n−1) y-axis coordinates, and the block image data generator generates the reference image data supplied to (m×n) blocks based on the coordinate information, where m and n are natural numbers greater than 2.

9. The display device of claim 1, wherein the luminance controller calculates the block reference current by sensing the block current when the display device is powered on or powered off and stores the block reference current in a memory.

10. The display device of claim 1, wherein each of the plurality of blocks has a maximum load when the reference image is displayed on each of the plurality of blocks.

11. The display device of claim 1, wherein the reference image includes a white image.

12. A luminance control device comprising:

a coordinate generator configured to generate coordinate information for dividing a display panel of a display device into a plurality of blocks;

a block image data generator configured to generate reference image data based on the coordinate information;

a current sensor configured to sense a current flowing in each of the plurality of blocks;

a block reference current calculator configured to calculate a block reference current based on a block current sensed in each of the plurality of blocks when a reference image is sequentially displayed on the plurality of blocks;

a memory configured to store the block reference current;

a block load calculator configured to calculate a block load of each of the plurality of blocks based on the coordinate information and input image data;

a target current calculator configured to calculate a target current of each of the plurality of blocks based on the block reference current and the block load; and a scaling factor calculator configured to calculate a scaling factor based on the target current and a sensing current sensed in each of the plurality of blocks when an input image corresponding to the input image data is displayed on the display panel.

13. The luminance control device of claim 12, wherein the block image data generator sequentially supplies the reference image data to a data driver.

14. The luminance control device of claim 12, wherein the block reference current calculator outputs an average value of the block current sensed for a preset time period as the block reference current.

15. The luminance control device of claim 12, wherein the block load calculator calculates the block load of each of the plurality of blocks based on a total load of the input image data.

16. The luminance control device of claim 12, wherein the current sensor generates the block current by sensing a current in each of the plurality of blocks when the display device is powered on or powered off and generates the sensing current by sensing the current in each of the plurality of blocks when the input image data is input.

17. The luminance control device of claim 12, wherein the coordinate generator generates the coordinate information including (m−1) x-axis coordinates and (n−1) y-axis coordinates, and the block image data generator generates the reference image data supplied to (m×n) blocks based on the coordinate information, where m and n are natural numbers greater than 2.

18. The luminance control device of claim 12, wherein each of the plurality of blocks has a maximum load when the reference image is displayed on each of the plurality of blocks.

19. The luminance control device of claim 12, wherein the reference image includes a white image.

20. A method of driving a display device comprising:

dividing a display panel into a plurality of blocks based on coordinate information;

sequentially displaying reference images on each of the plurality of blocks;

sensing a block current in each of the plurality of blocks;

calculating a block reference current based on the block current;

storing the block reference current;

calculating a block load of each of the plurality of blocks based on the coordinate information and input image data;

calculating a target current of each of the plurality of blocks based on the block reference current and the block load;

displaying an input image corresponding to the input image data on the display panel;

sensing a sensing current in each of the plurality of blocks; and calculating a scaling factor for controlling a voltage level of a data voltage corresponding to the input image data based on the sensing current and the target current.

* * * * *